US006529818B2

(12) United States Patent
Kitajima et al.

(10) Patent No.: US 6,529,818 B2
(45) Date of Patent: Mar. 4, 2003

(54) CONTROL DEVICE FOR ENGINE HAVING AUTOMATIC STOP AND START FUNCTION

(75) Inventors: Shinichi Kitajima, Saitama (JP); Atsushi Izumiura, Saitama (JP); Atsushi Matsubara, Saitama (JP); Kan Nakaune, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/735,457

(22) Filed: Dec. 14, 2000

(65) Prior Publication Data

US 2001/0005807 A1 Jun. 28, 2001

(30) Foreign Application Priority Data

Dec. 14, 1999 (JP) ..... 11-353995

(51) Int. Cl.[7] ..... F02D 45/00; F01P 11/16
(52) U.S. Cl. ..... 701/112; 701/114
(58) Field of Search ..... 701/112, 114; 123/179.4

(56) References Cited

U.S. PATENT DOCUMENTS 5,270,935 A * 12/1993 Dudek et al. ..... 701/102
5,668,726 A * 9/1997 Kondo et al. ..... 701/114

FOREIGN PATENT DOCUMENTS

JP 60-113042 * 6/1985 ..... F02D/29/02
JP 4-246252 9/1992
JP 7-109936 * 4/1995 ..... F02D/41/02
JP 11-141337 5/1999

* cited by examiner

*Primary Examiner*—Andrew M. Dolinar
(74) *Attorney, Agent, or Firm*—Arent Fox Kintner Plotkin & Kahn, PLLC

(57) ABSTRACT

There is provided a control device for an engine including an automatic stop and start function, wherein detected data taken prior to an engine stop or results of an operation carried out based on the detected data are retained in executing an engine automatic stop control. In particular, in a case where the technology is applied to an engine including a thermostat proper operation determination function, a thermostat proper operation determination process is constructed so as to continue to be executed in executing an engine automatic stop control.

2 Claims, 5 Drawing Sheets

CONTROL DEVICE FOR ENGINE HAVING AUTOMATIC STOP AND START FUNCTION

BACKGROUND OF THE INVENTION

1. Field of the Invention

The present invention relates to a control device for an engine having an automatic stop and start function.

2. Description of the Related Art

Known in JP-A-4-246252 or the like is a vehicle having an engine automatic stop and start function in which the engine is automatically stopped when it goes into predetermined engine stopping conditions, and it is also automatically started when it goes into predetermined engine re-starting conditions. This technology has been developed to further promote the reduction of exhaust gas emissions and conservation of energy.

On the other hand, a thermostat is provided on a water-cooled engine which has a function to maintain the temperature of water in a water jacket within a predetermined range, and an abnormal operation of the thermostat invites a reduction of combustion efficiency attributed to improper engine temperatures, worse exhaust gas properties and fuel economy thereby resulting. Due to this, recently it is one of significant subjects in the field of engine control to find an abnormal state of the thermostat at an earlier stage.

Proposed as a means for finding an abnormal state of a thermostat at an earlier stage in, for example, JP-A-11-141337 is a system in which the quantity of intake air which is directly related to the total heat release value of an engine is accumulated since the engine is started and in which, when the accumulated value of the quantity of intake air has reached a predetermined value, an estimated cooling water temperature calculated based on a total heat release value of the engine estimated from the accumulated value on condition that the thermostat is in normal operation is compared with an actually measured cooling water temperature actually measured by a cooling water temperature sensor, whereby the thermostat is determined to be in an abnormal state when a deviation between the estimated cooling water temperature and the actually measured cooling water temperature exceeds a predetermined value.

In recent years, however, the combustion control of an engine which is related to the ignition timing or the quantity of injected fuel is generally controlled in an electronic fashion, and on suitable occasions data in a CPU installed in an electronic control unit (ECU) needs to be initialized and a self-diagnostic process also needs to be performed on the CPU on such occasions. Conventionally, it is common practice to execute the initialization of data and self-diagnostic process at the time of cranking.

However, in a case where an engine automatic stop and start function is applied to a vehicle equipped with the aforesaid thermostat proper operation determination function, since the CPU is initialized when the engine is re-started after it has been automatically stopped, there may be a risk of interrupting the thermostat proper operation determination based on an accumulated value of the quantity of intake air since the engine is initially started.

SUMMARY OF THE INVENTION

The present invention was made with a view to solving such a problem inherent in the related art, and an main object thereof is to provided a control device improved such that even if an automatic stop and start function is added to a vehicle, there is caused no risk of a thermostat proper operation determination device malfunctioning to make a wrong judgement With a view to attaining the above object, according to aspects of the invention, there is provided a control device for an engine includeng an automatic stop and start function, wherein detected data taken prior to an engine stop or results of an operation carried out based on the detected data are retained in executing an engine automatic stop control. In particular, in a case where the technology is applied to an engine including a thermostat proper operation determination function, a thermostat proper operation determination process is constructed so as to continue to be executed during an engine automatic stop control.

According to the constructions, since the processes are jumped to be performed when the engine is initially started, the accumulated data for use in determining whether the thermostat is in proper operation does not have to be initialized.

DETAILED DESCRIPTION OF THE PREFERRED EMBODIMENTS

Referring to the accompanying drawings, the invention will be described in detail below.

Figure 1:
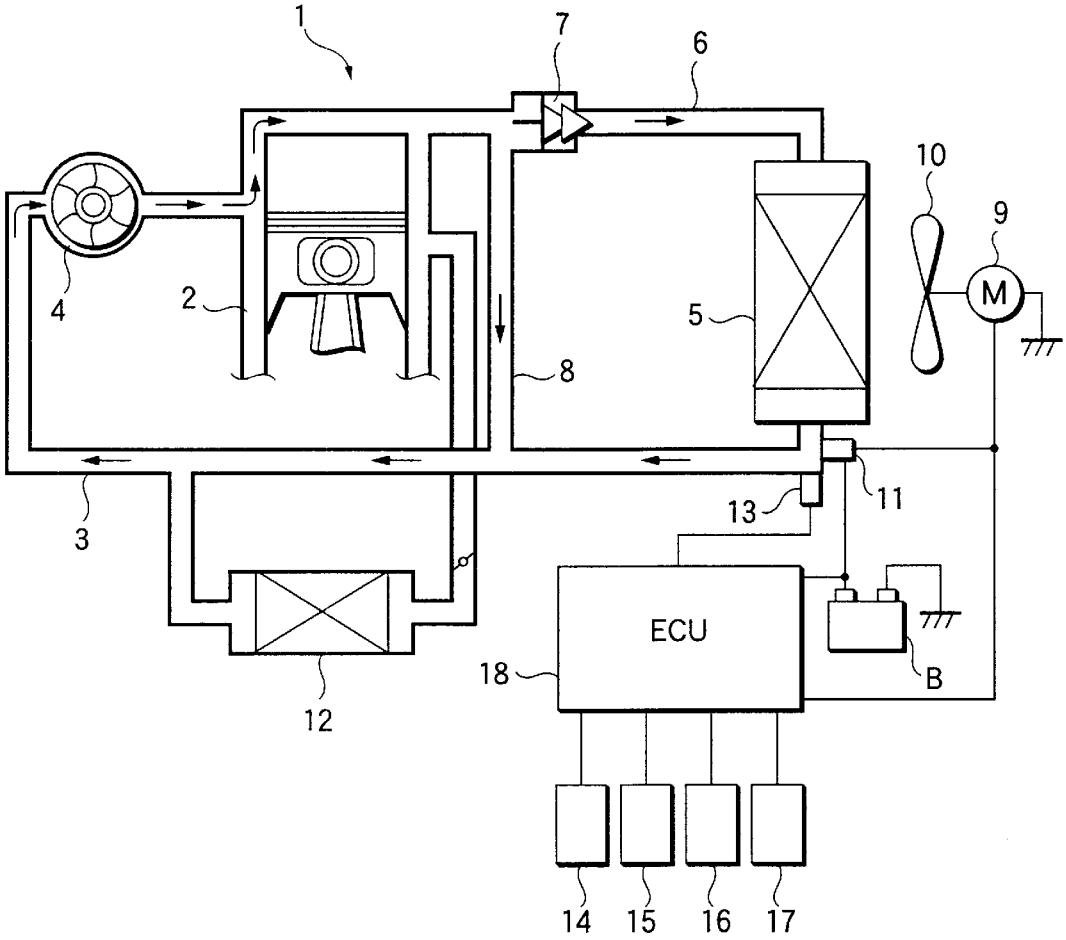
FIG. 1 is a typical diagram showing an engine cooling system to which the invention is applied.

FIG. 1 is a typical diagram showing an engine cooling system to which the invention is applied. In FIG. 1, a water jacket 2 formed within a cylinder block of an engine 1 is connected at one end to a bottom side of a radiator 5 via a cooling water supply passage 3 and a water pump 4 and at the other end to a top side of the radiator 5 via a cooling water discharge passage 6 and a thermostat 7. The cooling water discharge passage 6 communicates with an upstream side of the water pump 4 via a bypass passage 8 which is branched off before the thermostat 7.

Cooling water discharged from the water pump 4 returns to the water pump 4 via the water jacket 2 and the bypass passage 8 when the thermostat 7 is closed, whereas when the thermostat 7 is open, the cooling water so discharged flows into the radiator 5 from the water jacket 2 via the cooling water discharge passage 6.

A fan 10 is additionally provided on the radiator 5 which is adapted to be driven by an electric motor 9. The fan 10 is constructed so as to be driven intermittently when the voltage of a battery B is applied thereto via a temperature switch 11 provided on the bottom side of the radiator 5. Therefore, the temperature of the cooling water within the water jacket 2 or the temperature of the engine is maintained within a predetermined range by operating the thermostat 7 so as to be opened or closed while allowing heat to be dissipated from the radiator 5.

Note that a heater 12 for heating the passenger compartment is connected between the water jacket 2 and the cooling water supply passage 3, and the part of cooling water heated by the engine 1 is constructed so as to be used as a source of heating.

The electric motor 9 for driving the fan 10 is connected to an electronic control unit 18 for controlling the engine 1 based on detected values from a cooling water temperature sensor 13 for detecting the temperature of cooling water on a downstream side of the radiator 5, an engine speed sensor for detecting the engine speed of the engine 1, a manifold air pressure sensor 15 for detecting the load of the engine 1, a vehicle speed sensor 16 for detecting the running speed of the vehicle and a temperature sensor 17 for detecting the atmospheric temperature.

The engine 1 is constructed so as to automatically be stopped when the stop of the vehicle is confirmed or predetermined conditions for predicting the stop of the engine are met. In executing the automatic stop control, a flag is set in a control program which indicates that an automatic stop control is being executed.

An abnormal operation of the thermostat 7 induces a reduction in combustion efficiency attributed to improper engine temperatures and causes deterioration in exhaust emissions properties and fuel economy. To cope with this, a monitor system for monitoring the operating state of the thermostat 7 is incorporated in the electronic control unit 18 of the engine to which the invention is applied.

Figure 2:
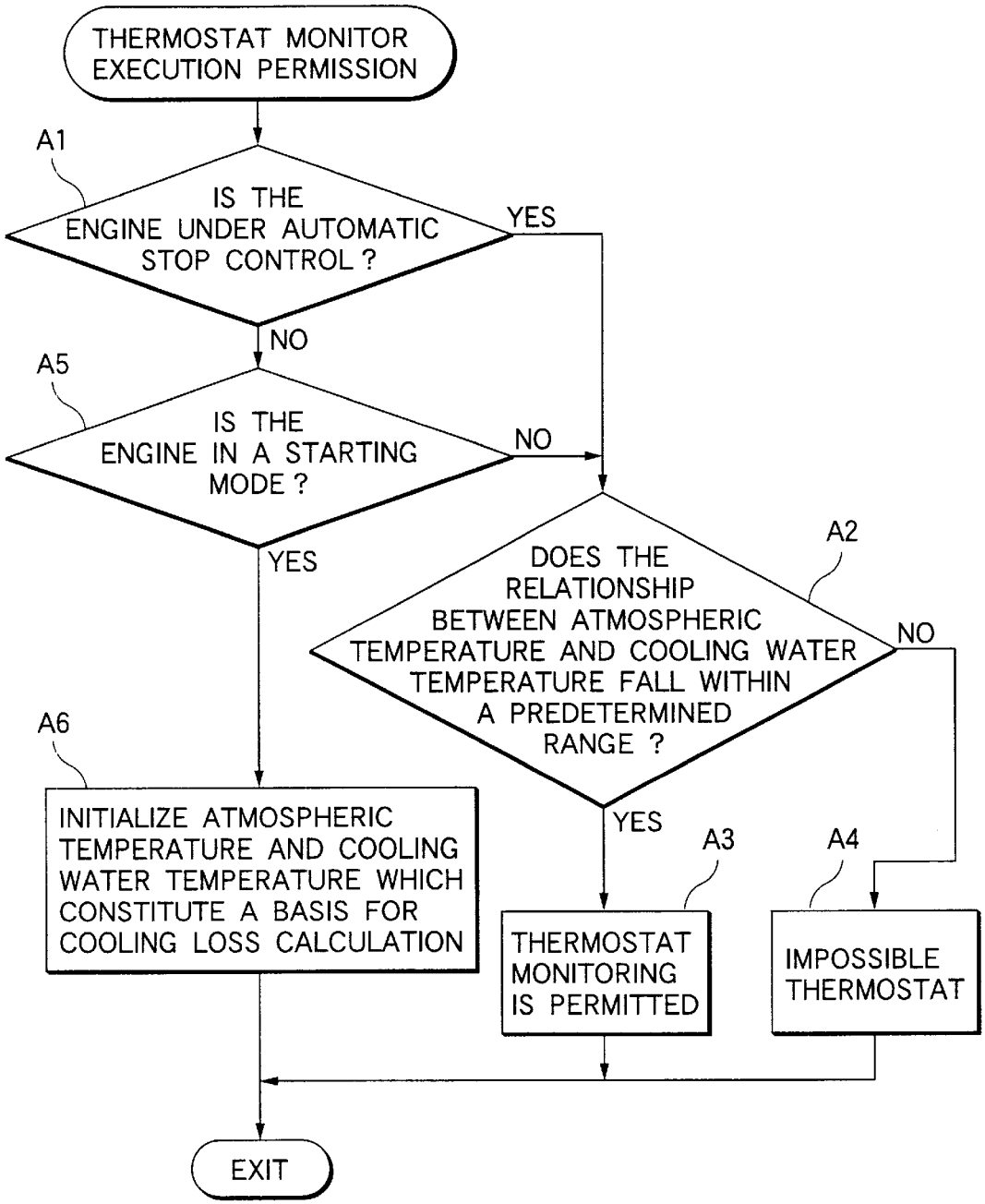
FIG. 2 is a schematic flowchart of a thermostat monitor execution permission routine.

Referring to FIG. 2, a thermostat monitor execution permission routine will be described next. First, whether or not the engine is currently under automatic stop control is determined (Step A1). In the event that the automatic stop control is being executed in this step, whether or not initial values of both the temperature and the cooling water temperature fall within a predetermined environmental range (for example, −6.7 to 45 degrees C.) is determined, and also whether or not a value resulting when the atmospheric temperature is subtracted from the cooling water temperature when the engine is initially started falls, within a predetermined value (for example, 6 degrees C.) is determined (Step A2). In the event that the engine goes into these conditions, the monitor execution permission flag is set to 1 (Step A3), whereas the engine does not go into those conditions, the monitor execution permission flag is set to 0 (Step A4).

In the event that the engine is not currently being under automatic stop control in Step A1, whether or not the engine is in a starting mode or whether or not the ignition key has been operated so as to put the engine in an idling state is determined (Step A5), and in the event that the engine is determined not to be in the starting mode here, then the flow advances to Step A2, whereas in the event that the engine is determined to be in the starting mode, data related to the atmospheric temperature and the cooling water temperature both of which constitute a basis for the cooling loss calculation is initialized (Step A6).

Figure 3:
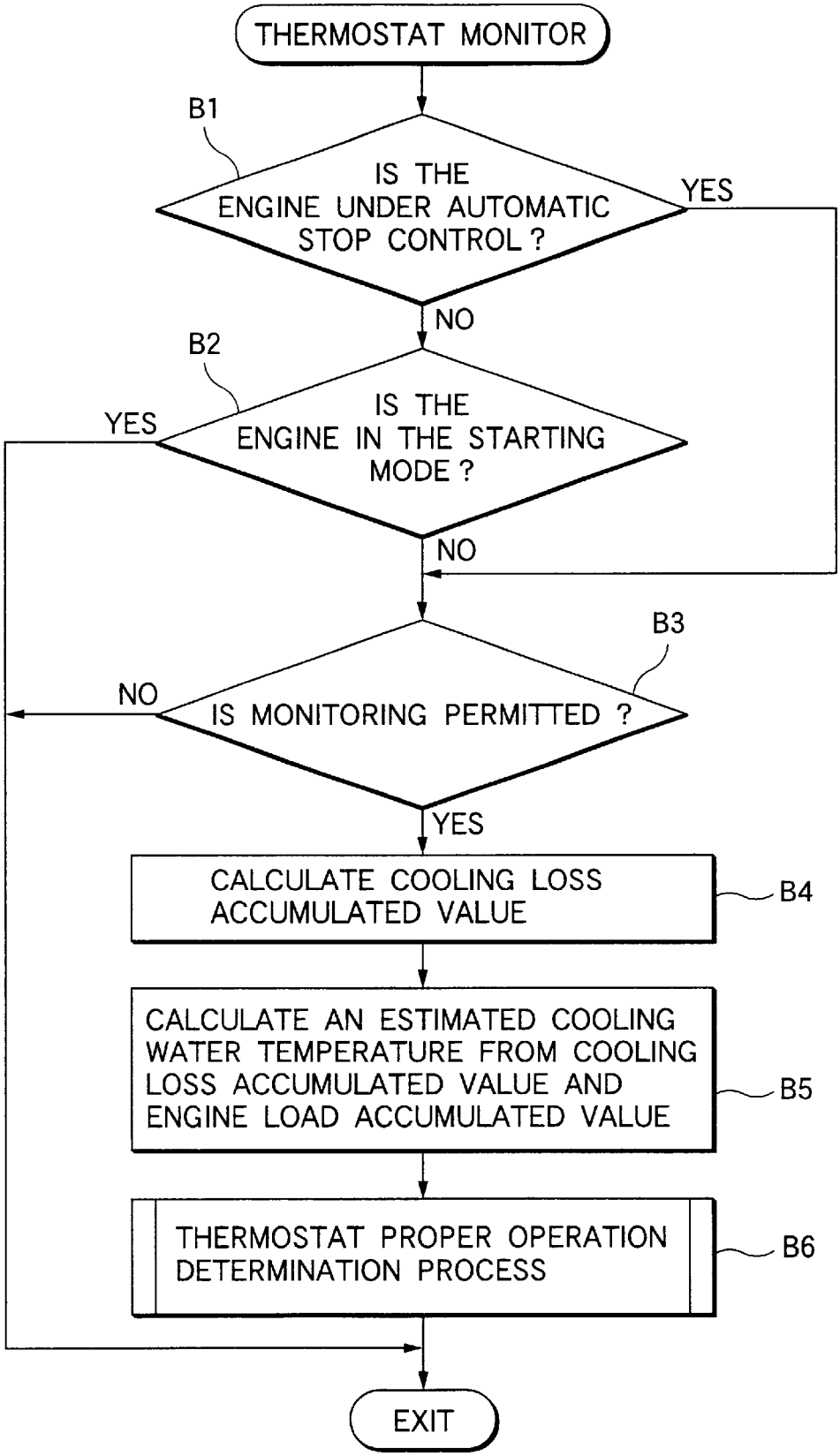
FIG. 3 is a schematic flowchart of a thermostat monitor routine.

Next, a thermostat monitor routine will be described with reference to FIG. 3. First, whether or not the engine is being under automatic stop control is determined (Step B1), and in the event that the engine is determined to be under automatic stop control,jumping a starting mode determination step B2 and checking on the thermostat monitor permission flag whether or not the execution of the monitoring of the thermostat is permitted is determined (Step B3). Here, in the event that the execution of the monitoring of the thermostat is determined to be permitted (flag is set to 1), there after a cooling loss accumulated value is calculated (Step B4) from a heat dissipation value through usage of the heater, a heat dissipation value through running wind and the atmospheric temperature. And, an estimated cooling temperature when it is predicted that the thermostat operates properly is calculated from the cooling loss accumulating valve and an engine load accumulated value obtained separately from the cooling loss accumulated value (Step B5). Then, whether or not the thermostat operates properly is determined by comparing the estimated cooling temperature and an actually measured cooling water temperature (Step B6).

Figure 4:
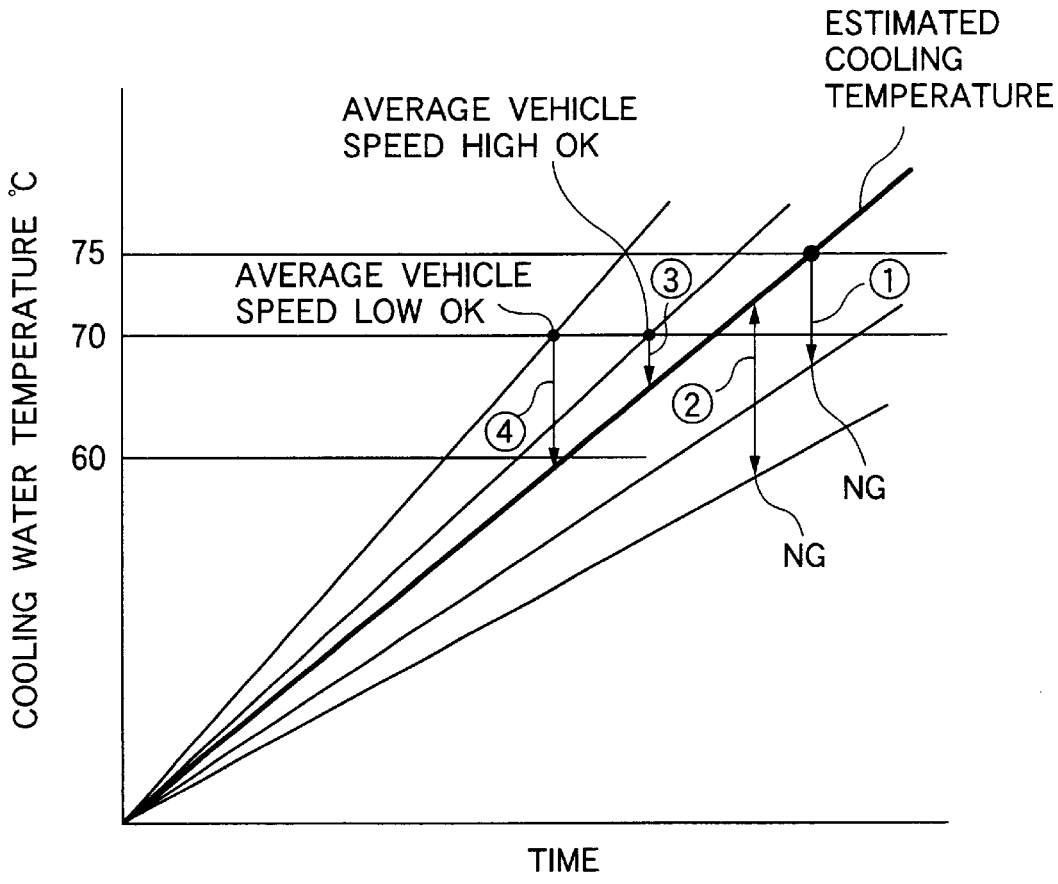
FIG. 4 is a graph showing cooling water temperature increase properties lines related to determination on the failure of a thermostat.

Here, the determination whether or not the thermostat operates properly will briefly be described. As shown in FIG. 4, when the estimated cooling water temperature reaches a failure determination value (for example, 75 degrees C.) before the actually measured cooling water temperature reaches a proper operation determination value (for example, 70 degrees C.), then it is determined that the thermostat is in failure (see arrow ① of FIG. 4). Additionally, in the event the actually measured cooling temperature is lower a predetermined value (for example, 15 degrees C.) than the estimated cooling temperature before the actually measured cooling water has reached the proper operation determination value and before the estimated cooling temperature has reached the failure determination value, then it is determined that the thermostat is in failure (see arrow ② of FIG. 4).

In the event that an average vehicle speed when the actually measured cooling temperature has reached the proper operation determination value is equal to or greater than a predetermined value (for example, 30 km/h), the thermostat is determined to operate properly even if the actually measured cooling temperature is higher than the estimated cooling temperature (see arrow ③ of FIG. 4). Additionally, even if an average vehicle speed when the actually measured cooling water temperature has reached the proper operation determination value is equal to or smaller than the predetermined value, the thermostat is determined to operate properly if the estimated temperature is a predetermined value (for example, 60 degrees C.) or less (see arrow ④ of FIG. 4).

In the event that the engine is determined not to be under automatic stop control in Step B1, then in Step B2, whether or not the engine is in the starting mode is determined, and in the event that the engine is determined to be in the starting mode here, remaining steps onward are jumped without condition. In contrast, in the event that the engine is here determined not to be in the starting mode, in Step B3, the thermostat monitor permission flag is checked to determine whether or not a monitor permission has been granted. In the event that the monitor permission flag is set at 1, then the flow advances to the aforesaid thermostat proper operation determination process, and on the contrary, in the event that the monitor permission flag is set at 0, steps onward are jumped.

Figure 5:
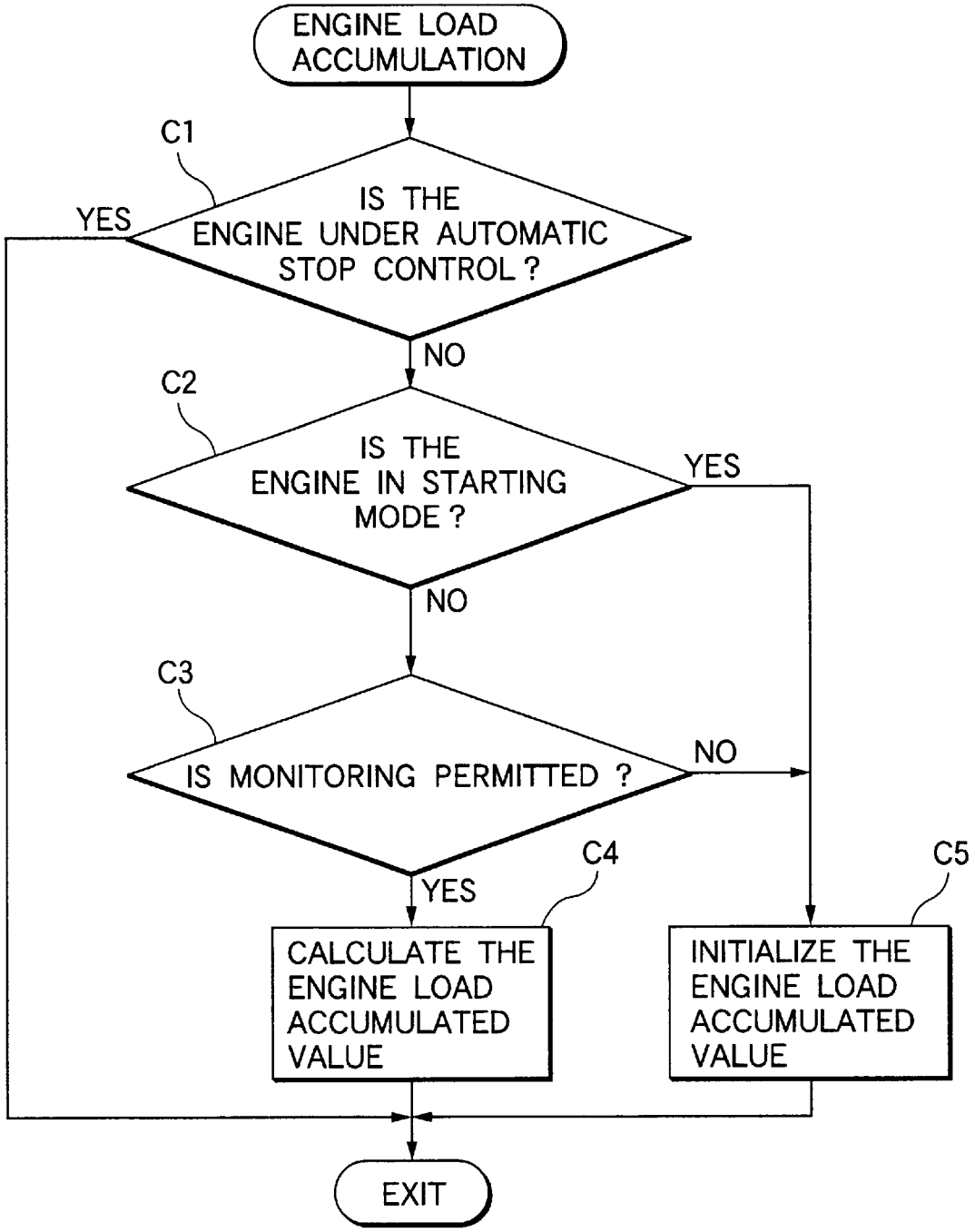
FIG. 5 is a schematic flowchart of an engine load accumulation routine.

Note that as shown in FIG. 5, the engine load accumulation is performed in Step C4 on conditions that the engine is not under automatic stop control (determined in Step C1), that the engine is not in the starting mode (determined in Step C2), and that the monitor permission is granted (determined in Step C3). In the event that the engine is under automatic stop control, remaining steps onward are jumped, and in the event that the engine is in the starting mode or that no monitor permission is granted (flag is set at 0), then the data related to the engine load accumulation is initialized (Step C5).

The engine load accumulation is obtained by correcting the fuel injection time with a function of the engine speed and manifold air pressure.

While only certain embodiments of the invention have been specifically described herein, it will apparent that numerous modifications may be made thereto without departing from the spirit and scope of the invention.

Thus, according to the invention, when the engine is re-started after it has automatically been stopped, since processing steps that are to be performed when the engine is initially started are jumped, accumulated data for use in determining whether or not the thermostat operates properly does not have to be initialized. Consequently, the invention is remarkably advantageous in preventing the thermostat from malfunctioning to make a wrong decision on whether or not the thermostat properly operates when the engine automatic stop and start function is added to the vehicle.

What is claimed is:

1. A control device for an engine having an automatic stop and start function, the engine including means for detecting values indicative of the engine operation, the control device comprising:

an electronic control unit for controlling an engine based on the detected values;

a memory device, the memory device for storing the detected values when the engine automatic stop function is executed, wherein at least one of the detected values taken prior to an engine stop function and an operation result which was carried out based on the detected value are stored in the memory device; and a thermostat proper operation determination function, wherein when the engine automatic stop function is executed, a thermostat proper operation determination process is continuously executed based on the detected values taken prior to the engine stop function and the operation result.

2. The control device according to claim 2, wherein when said engine is in idling state, at least one of said detected values and operation result are initialzed.

* * * * *